US006234533B1

(12) United States Patent
Torimoto

(10) Patent No.: US 6,234,533 B1
(45) Date of Patent: May 22, 2001

(54) COVER OR CARD

(76) Inventor: Norio Torimoto, Lomvägen 117, 192 56 Sollentuna (SE)

( * ) Notice: Subject to any disclaimer, the term of this patent is extended or adjusted under 35 U.S.C. 154(b) by 0 days.

(21) Appl. No.: 09/147,950

(22) PCT Filed: Sep. 16, 1997

(86) PCT No.: PCT/SE97/01563

§ 371 Date: May 21, 1999

§ 102(e) Date: May 21, 1999

(87) PCT Pub. No.: WO98/13215

PCT Pub. Date: Apr. 2, 1998

(30) Foreign Application Priority Data

Sep. 25, 1996 (SE) ..... 9603507

(51) Int. Cl.[7] ..... B42D 3/00
(52) U.S. Cl. ..... 281/33
(58) Field of Search ..... 281/29, 33, 36, 281/37, 21.1, 15.1

(56) References Cited

U.S. PATENT DOCUMENTS

| | | | | |
|---|---|---|---|---|
| 2,256,513 | * | 9/1941 | Bauer | 281/33 |
| 2,375,190 | | 5/1945 | Botts . | |
| 3,121,576 | | 2/1964 | Schade . | |
| 3,334,920 | | 8/1967 | Orth . | |
| 3,367,679 | * | 2/1968 | Slanhoff | 281/33 |
| 3,383,120 | * | 5/1968 | Guiles | 281/33 |
| 3,990,669 | | 11/1976 | Smith . | |
| 4,015,863 | | 4/1977 | Holum . | |
| 4,355,821 | | 10/1982 | Crawford . | |
| 4,377,271 | | 3/1983 | Smith . | |
| 4,552,479 | * | 11/1985 | Nickow et al. | 281/33 X |

* cited by examiner

*Primary Examiner*—Willmon Fridie, Jr.
(74) *Attorney, Agent, or Firm*—Pillsbury Madison & Sutro LLP

(57) ABSTRACT

A device is provided with a structure capable of forming a display stand for a cover or card. The device may be used with books, folders and albums, as well as with binders such as ring-back binders, spring-back binders or other similar items. The device includes a first and second sides, each of which includes an upper, lower, and forward edge. A spine connects the first and second sides. Finally, a fold line is provided on one surface of the device, permitting the device to bend along the line and form a display stand for supporting the device.

11 Claims, 2 Drawing Sheets

COVER OR CARD

This application is the national phase of international application PCT/SE97/01563 filed Sep. 16, 1997 which designated the U.S.

BACKGROUND OF THE INVENTION

1. Field of the Invention

The present invention refers to a cover intended for use with books, folders and albums as well as with binders such as ring-back binders, spring-back binders or similar. The cover is thus intended to be used on all occasions where the cover encloses items in sheet form placed in the cover. The cover can also consist of a card of stiff material, such as a congratulations card where the card itself contains the message that is to be communicated.

There are numerous occasions when one wishes to display and show certain contents of a book or a binder. Suitable occasions for books arise with cookery books or other kinds of books that contain descriptions or instructions to be read step-by-step at the same time as other actions are performed. Similar occasions arise with signs or information contained in binders at shops, exhibitions and similar when a customer may need to browse among different pages when looking for something special. Such occasions also arise, for example, when an album of photographs is to be shown to visitors.

2. Description of the Related Art

For the cover of a book or ring-backed binder or similar to be kept open and the contents readable, it is usual for the spine of the cover to be inclined at an angle between the horizontal plane and the vertical plane so that the folder or the book does not close. Different solutions for solving the problem of displaying the contents in a binder a simple manner are described, for example, in U.S. Patent No. 4,355,821, which shows a ring binder where the ring holder can be separated from the lower part of the rear binder cover, which can then be bent backwards from the ring holder to form a support so that the ring holder stands at the desired angle. A ring binder where the lower ring holder is also separated from the spine of the binder is also known from U.S. Pat. No. 4,377,271. In this case, the ring holder holding the contents adopts the inclined position, while the spine of the binder is placed in essentially a vertical position. In addition, U.S. Pat. No. 4,576,498 describes a ring binder where the ring holder is equipped with a pull-out support that is drawn out when needed and folded out behind the binder where it maintains the ring holder in an inclined position.

BRIEF SUMMARY OF THE INVENTION

The object of this present invention has been to produce a binder cover that displays its contents in as simple a manner as possible. In addition to displaying the contents of a ring-backed binder, the binder cover also displays other types of items such as a book, a folder, a card, or similar, as previously mentioned.

Another object of the invention has been to produce a cover of the type mentioned previously that can also be used to enclose existing binders for ring-back binders, books or similar.

DETAILED DESCRIPTION OF THE INVENTION

Figure 1:
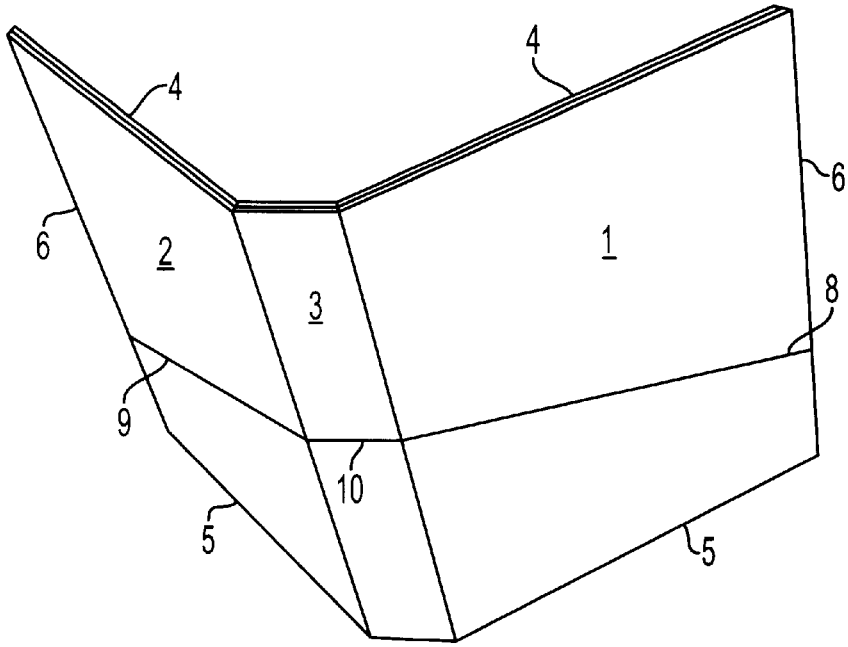
FIG. 1 is a schematic view of a cover in its normal position according to the invention as seen from the rear.

FIG. 1 shows an ordinary ring-back binder comprising a front side 1 and a rear side 2 plus a spine that holds the two together. Each front and back side comprises an upper edge 4 and a lower edge 5 as well as a forward edge 6. The binder in FIG. 1 is known as a ring-back binder, as can be seen in FIG. 3, which shows the inside of the binder with the rings clips 7 visible.

On the front side 1, as line 8 extends from the spine 3 to the forward edge 6 at an angle sloping downwards in the direction from the spine 3 to the forward edge 6. In the same way, a line 9 extends on the rear side 2 downwards from the spine 3 to the forward edge 6. Similarly, a line 10 extends across the spine 3 to join lines 8 and 9. Lines 8, 9 10 show the folds along which the sides 1, 2 and the spine 3 can be bent back as indicated by the arrow in FIG. 2 so that the upper edges of the sides are turned downwards.

Figure 2:
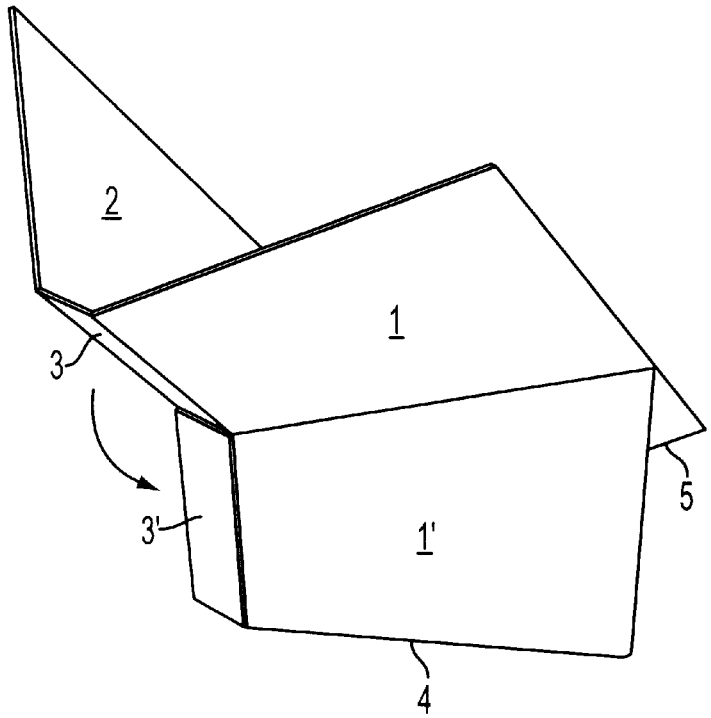
FIG. 2 shows the equivalent cover from approximately the same viewpoint but arranged to show its contents.
Figure 3:
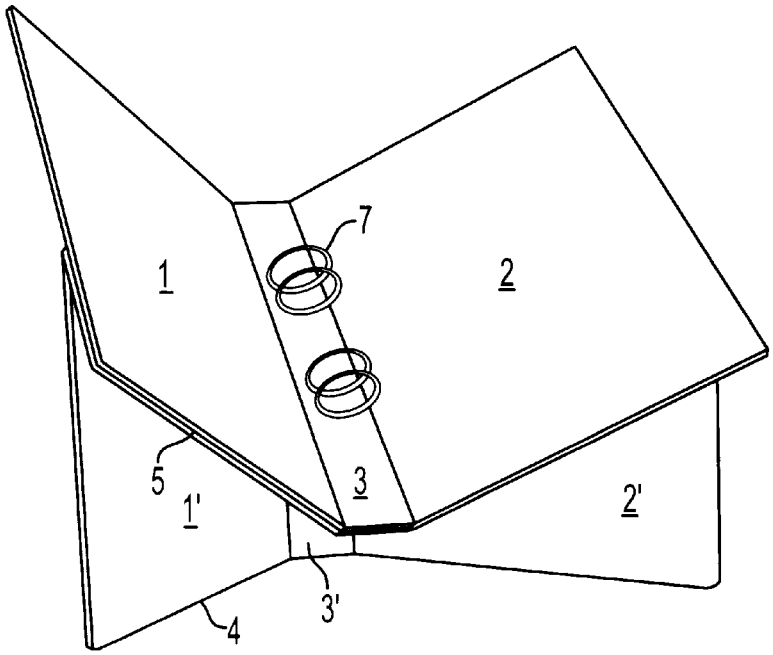
FIG. 3 shows the equivalent cover as illustrated in FIGS. 1 and 2 and arranged as in FIG. 2 but viewed from the opposite side.

In the design of the cover according to the embodiment shown in FIGS. 1–3, the sides of the cover have double layers where both layers are separated from each other above lines 8, 9 and 10. Below lines 8, 9 and 10, the two layers of the sides and on the spine are bound to each other. Lines 8, 9 and 10 thus form the upper boundary of the bound double layers. This double-layered design allows the inside of the layers to provide their customary support for the contents of the binder. After bending back as shown in FIG. 2, the binder cover and its contents can be positioned so as to display the contents. As shown in FIG. 3, the angle of lines 8 and 9 determines the inclination of the binder cover in relation to how far cover sides 1 and 2 are opened up from each other.

Since both the bent-down cover sides 1', 2' are still connected with each other through the similarly bent-down spine 3', the cover forms a very stable platform for the binder and shows no tendency to tip over. Placing additional weight on the cover merely makes it more stable and possibly causes the two bent-down cover sides to move closer to each other, thus reducing the angle at which the binder opens.

Figure 4:
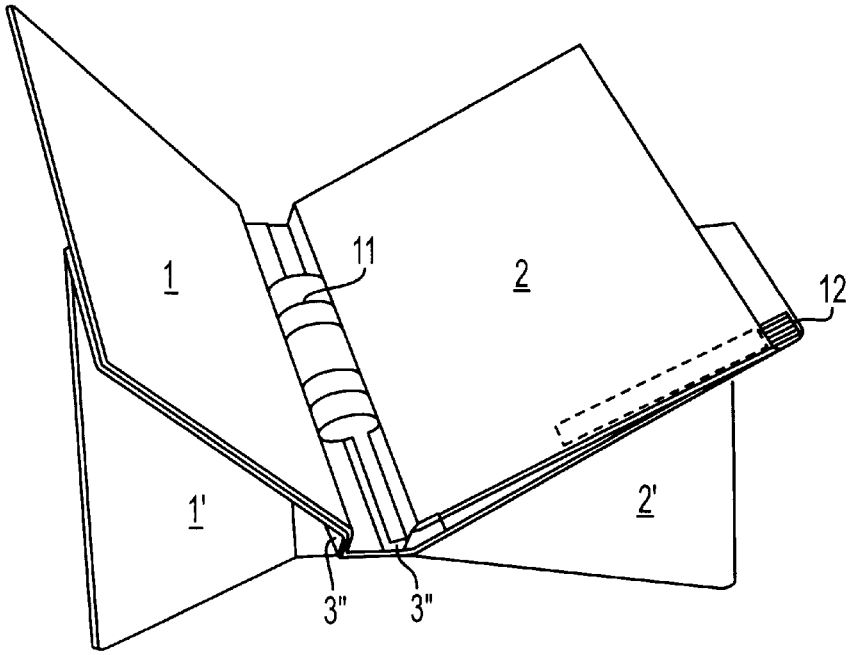
FIG. 4 shows a cover similar to that of FIG. 3 and from the same viewpoint.

FIG. 4 shows another embodiment including a spring-back binder cover, for example, as indicated schematically by the spring clips 11, and where the spine of the cover has a folded ridge 3". A double-layered binder cover of this type could not be bent based in the same way as the cover shown in FIGS. 1–3 if both lower sections of the cover were permanently attached to each other as mentioned previously regarding the design in FIGS. 1–3 as it would be impossible to bend back the cover at the ridge on the spine. In this design, therefore, the lower part of the rear cover 2 has been designed so that both layers of the side can be separated from each other and then rejoined with, for example, a teasel strip (Velcro® strip) 12 as indicated in FIG. 4. When the cover is to be folded out, both layers of the side are therefore separated by pulling apart the teasel strip (Velcro® strip) and pulling back the foldable layer of the rear side, whereby both the spine ridges stick out and can thus be folded back. Following this, both the lower sections of the rear side are reunited with the help of the teasel strip (Velcro® strip) 12, taking up the position shown in FIG. 4.

According to the invention, the cover can also be used as a cover for an existing binder, a book or similar and where, for example, the cover according to the invention can be provided with an elasticised band or similar at its corners and with which the cover according to the invention can hold the book or binder to be enclosed by the cover according to the invention.

The material in the cover or card according to the invention can be of any suitable material, such as plastic or paper provided with suitable folds along which the cover is bent back to form the base for displaying the binder.

The use of the invention is naturally not restricted to the items mentioned above, but is suitable for all occasions where a binder cover is used to enclose material.

What is claimed is:

1. A device comprising:

a first side;

a second side positioned opposite to the first side;

wherein each of the first and second sides includes an upper edge, a lower edge, and a forward edge;

a spine hingedly connecting the first and second sides; and a fold line arranged on a first surface portion of the device, the line extending outward from the spine to a point along each of the forward edges;

wherein the device is bendable along the line so that when the device bends, a portion of the device above the line is foldable along the line such that a portion of the upper edges, having been folded, extends below the lower edges, thereby forming a display stand for the device; and wherein a portion of the device below the line includes supporting pockets, the supporting pockets being formed along the lower edges and configured for securing contents.

2. A device according to claim 1, wherein the line slopes in a direction towards the lower edges.

3. A device according to claim 2, wherein the line extends across the spine to each of the front edges.

4. A device according to claim 1, wherein the contents include one of a binder, a book, and an album.

5. A device according to claim 4, wherein the spine includes a ridge, at least one of the sides being able to be separated from the contents, thus allowing the ridge to be extended from the contents when the device is bent, the at least one side adapted to be reattached to the contents.

6. A device according to claim 5, wherein the side reattaches to the contents by a teasel strip.

7. A device according to claim 1 wherein the point along the forward edges is positioned closer to the lower edges than the upper edges.

8. A device comprising:

a first side;

a second side positioned opposite to the first side;

wherein each of the first and second sides includes an upper edge, a lower edge, and a forward edge;

a spine hingedly connecting the first and second sides; and a fold line arranged on a first surface portion of the device, the line extending outward from a point on the spine to the forward edges;

wherein the device is bendable along the line so that when the device bends, a portion of the device above the line is foldable along the line such that a portion of the upper edges, having been folded, extends below the lower edges, thereby forming a display stand for the device;

wherein the line slopes toward the lower edges; and wherein a portion of the device below the line includes supporting pockets, the supporting pockets being formed along the lower edges and configured for securing contents.

9. A device comprising:

a flexible member including a top portion and a bottom portion; and a first folding line hingedly connecting the top and bottom portions;

wherein (i) the flexible member is adapted to fold along the first folding line, (ii) the top and bottom portions overlapping when the flexible member folds, (iii) the overlapping portions thereby forming a folded segment, the folded segment including:

a first side;

a second side positioned opposite to the first side;

wherein each of the first and second sides includes an upper edge, a lower edge, and a forward edge;

a spine hingedly connecting the first and second sides; and a second fold line arranged on a first surface of the bottom portion, the second fold line extending outward from a point on the spine to the forward edges;

wherein the folded segment is bendable along the second fold line so that when the folded segment bends, a portion of the folded segment above the second fold line is foldable along the second fold line such that a portion of the upper edges, having been folded, extends below the lower edges, thereby forming a display stand for the device; and wherein the second fold line slopes toward the lower edges.

10. A device according to claim 9, wherein the second fold line slopes in a direction towards the lower edges.

11. A device according to claim 10, wherein the second fold line extends across the spine to each of the front edges.

* * * * *